United States Patent [19]

Wesch

[11] 4,050,073

[45] Sept. 20, 1977

[54] SUPPORT FOR FOAM ABSORBER OF ELECTROMAGNETIC WAVES

[76] Inventor: Ludwig Wesch, Goerrestrasse 54, 6900 Heidelberg, Germany

[21] Appl. No.: 648,937

[22] Filed: Jan. 14, 1976

[51] Int. Cl.[2] ..... H01P 1/22

[52] U.S. Cl. ..... 343/18 A; 333/81 R

[58] Field of Search ..... 333/22 R, 22 F, 81 R, 333/81 B; 343/18 A

[56] References Cited

U.S. PATENT DOCUMENTS

| | | | |
|---|---|---|---|
| 2,567,379 | 9/1951 | Kienow | 333/22 R |
| 2,968,775 | 1/1961 | Rose | 333/81 B |
| 2,977,591 | 3/1961 | Tanner | 333/81 R X |

*Primary Examiner*—Paul L. Gensler

[57] ABSTRACT

Support for foam absorber for electromagnetic waves. The support is constituted by one or more filaments impregnated with a plastic material which may be either thermohardening or thermoplastic. The support has a generally pyramidal form. The plastic material employed for the impregnation of the wound filaments has a dielectric constant less than six.

4 Claims, 4 Drawing Figures

SUPPORT FOR FOAM ABSORBER OF ELECTROMAGNETIC WAVES

The present invention relates to absorbers for electromagnetic waves.

Foam absorbers are principally employed in the art of absorbing electromagnetic waves. The foams employed may be foams of polyurethane, of polystyrene, of polyethylene or the like. They are filled with graphite and/or are themselves conductive in such manner that they produce a good effect of absorbing electromagnetic waves of all lengths and of wide frequency bands. The form of such foam absorbers is in general that of a pyramid. The longer the wavelength of the wave to be absorbed, the greater must be the size of the pyramid.

Incidentally, the pyramids must be oriented in the direction of the incident waves in order to obtain a maximum absorption. In certain cases the pyramids are affixed by their bases upon a vertical wall that has the appearances of a large overhang.

It has been established that the shape of these foam absorbers have a tendency to change taking into account notably their dimensions and their orientation. However, when such deformation of the pyramidal form of the absorber occurs a notable modification of the absorption characteristics also occurs which obviously should be avoided.

It is for this reason that the invention provides essentially a support adapted to prevent all mechanical deformation of a foam absorber without substantially modifying its absorption effect.

More precisely, the invention provides a support for a foam absorber characterized by the fact that it is constituted of a perforated winding of one or more filaments impregnated with a heat hardenable or thermoplastic material.

By preference, the support in the invention presents a form which is generally pyramidal, each of the ridges of the pyramid being reinforced by an elongated element upon which there are enrolled the one or more resin impregnated elements.

The thermally hardenable or thermoplastic resin used for the impregnation has a low dielectric constant, such constant being advantageously less than 6.

The invention also provides a method for making of the support which is described above. Such method includes the winding of a filament impregnated with a heat hardenable plastic material upon a mandrel after putting in place upon the latter elongated reinforcing elements, the winding being conducted in such manner as to prepare a plurality of apertures of limited dimensions, such winding proceeding in accordance with known technique for the winding of filamentary materials.

The invention will be more readily understood upon consideration of the following description and of the drawings annexed hereto showing exemplary embodiments of the invention.

IN THE DRAWINGS

Figure 1:
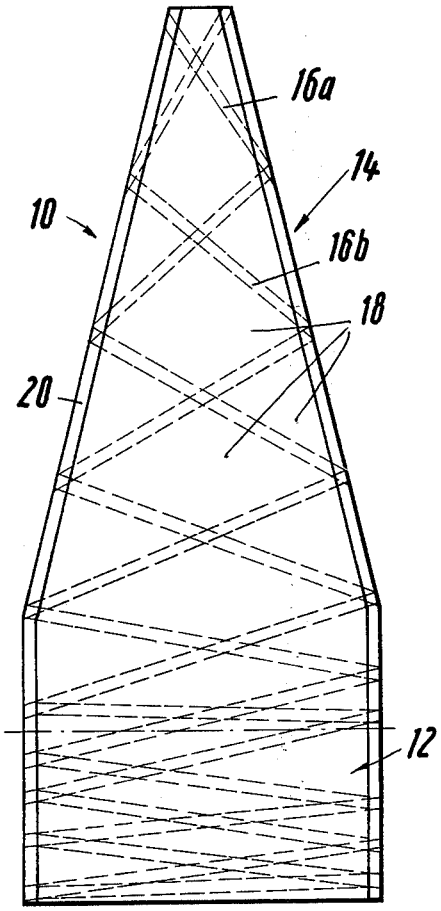
FIG. 1 is a lateral view of a support for a foam absorber according to the invention.

In FIG. 1, the reference character 10 designates a frame-work of general pyramidal form adapted to constitute a support for granular or particulate material (not shown) for absorbing electromagnetic waves; such granular material may be conductive material such as graphite which is distributed throughout the foam. The framework support 10 includes a base in the form of a prismatic enclosure 12 having a cross section of triangular or rectangular shape, such framework having attaching means (not shown) secured thereto for mounting the framework support 10 upon a given vertical or horizontal wall and an upper pyramidal part 14 adapted to contain the granular wave absorbing material.

According to the invention the framework support is constituted essentially by a winding which forms apertures so as to have diamond shaped openings therethrough, the winding being formed from one or more filaments 16*a*, 16*b*, impregnated by a heat hardenable or thermoplastic plastic material. The winding is carried out in such manner as to provide openings 18 in the framework, such openings being of polygonal (triangular or diamond shaped), the largest transverse dimension of the polygon being chosen to be greater than 1/10 of the greatest length of the wave which is to be absorbed by the wave absorber (the length of the wave being determined in a vacuum) in such manner that the framework support 10 remains permeable to the incident wave. It has been found that the angle crossing of the filaments 16 may be chosen at will.

It is to be understood, that for forming and reinforcing the polygonal shape, one applies a plurality of layers of filaments one upon the other, the number of layers chosen depending upon the mechanical strength demanded of the frame-work support. The thickness of the winding may attain a dimension of 8 – 10 mm for a pyramid having a length of up to 2m.

With such winding the framework support presents numerous openings 18 such that its dielectric constant, taking into account the small surface carrier of the wound filaments, remains minimal and its influence upon the absorption effect of the granular or particulate absorbing material remains small.

In order to diminish this influence, in accordance with the invention plastic material employed for the impregnation of the filaments 16 is charged with an absorbent material, such as graphite or conductive soot or particulate carbon, in the amount of 2 – 10% of the volume of the thus charged filaments.

As far as the plastic impregnating material is concerned, for technical reasons it is preferred to employ synthetic resins having a low dielectric constant, that is a dielectric constant less than 6. By way of example, the plastic material employed is chosen from among heat hardenable synthetic resins such as unsaturated polyesters of all kinds, epoxide resins combined with appropriate hardeners, as well as thermoplastic synthetic resins.

For the wound filaments there may be employed glass fibers, graphite fibers, carbon fibers, asbestos fibers, or synthetic fibers such as polyester fibers as well as natural fibers. One can also use a mixture of these fibers such as for example a mixture of glas fibers and carbon fibers or graphite fibers, or a mixture of glass fibers and organic fibers such as polyamides.

Figure 2:
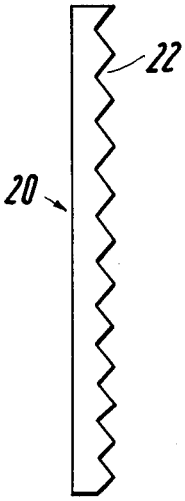
FIG. 2 illustrates a first preferred embodiment of the elongated reinforcing elements for the support shown in FIG. 1.
Figure 3:
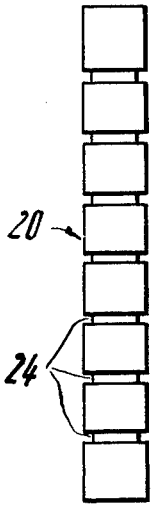
FIG. 3 shows a second preferred construction of the elongated reinforcing elements for the support of FIG. 1.
Figure 4:
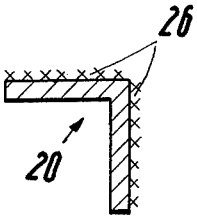
FIG. 4 is a fragmentary view in section on a greatly enlarged scale illustrating a further embodiment for production of the elongated reinforcing elements for the support of FIG. 1.

As shown in FIG. 1, the framework support 10 is preferably reinforced on its ridges by elongated reinforcing elements 20. These elements, of certain preferred embodiments are illustrated in FIGS. 2, 3, and 4. Such elements may present a transverse section of appropriate form that is triangular or rectangular for example, arcuate, even a aquare as shown in FIG. 4.

Preferably every elongated element 20 presents on at least one of its surfaces which is presented to the exterior of the supporting framework 10, called exposed sides, a discontinuous surface which can be produced by providing on such side roughnesses, reliefs, crosses, grains or other analoguous discontinuities.

In FIG. 2 the side in question sawtooth peaks 22. In FIG. 3 the exposed side of the elongated element 20 has a plurality of grooves 24.

In FIG. 4, the elongated element presents on its exposed sides a roughness 26 produced by grains of sand or quartz or any other similar granular material on the two sides of such element.

The fabrication of the framework support 10 may be carried out with a heatable filamentary winding machine of classic type.

Reinforcing elements 20 are disposed upon a mandrel having an appropriate form in order to incorporate them into the support 10 and there are then rolled a plurality of layers of filaments 16 impregnated with a desired plastic material. The winding is conducted in such manner as to obtain the apertures 18 in the form of diamonds as described above. After hardening the impregnated filaments the operator withdraws the mandrel and the support 10 is ready to be loaded or charged with the described granular absorbing material. It is to be understood that numerous modifications may be made in the described manners of production of the support without departing from the teachings of the present invention.

Although the invention is illustrated and described with reference to a plurality of preferred embodiments thereof, it is to be expressly understood that it is in no way limited to the disclosure of such a plurality of preferred embodiments, but is capable of numerous modifications witin the scope of the appended claims.

What is claimed is:

1. In a foam-type absorber of electromagnetic waves, a reinforcing framework comprising, in combination, a plurality of elongated outer support elements disposed in spaced relation and oriented to define the longitudinal edges of a pyramid, and a heat-hardenable strand wound in reentrant roving fashion about the support elements to define, between each adjacent pair of the support elements, a lattice-shaped lateral wall having a plurality of substantially diamond-shaped apertures therein, the lattice-shaped wall and the support elements cooperating to define a chamber, and foam-type electromagnetic absorbing means supported within the chamber.

2. An absorber according to claim 1, wherein the strand comprises at least one filament impregnated with a plastic material having a dielectric constant less than 6.

3. An absorber according to claim 1, wherein each elongated support element presents discontinuities upon its outer surfaces.

4. An absorber according to claim 1, wherein each elongated support element presents on at least its outer sides a plurality of spaced peaks.

* * * * *